United States Patent [19]

Bard

[11] Patent Number: 4,815,248

[45] Date of Patent: Mar. 28, 1989

[54] LARGE-FORMAT THIN-WALLED CERAMIC TILE

[75] Inventor: Martin Bard, Amberg, Fed. Rep. of Germany

[73] Assignee: Buchtal Gesellschaft mit beschrankter Haftung, Fed. Rep. of Germany

[21] Appl. No.: 14,842

[22] Filed: Jan. 21, 1987

[51] Int. Cl.[4] ..... E04C 1/40

[52] U.S. Cl. ..... 52/511; 52/506; 52/420

[58] Field of Search ..... 52/506, 511

[56] References Cited

U.S. PATENT DOCUMENTS

| | | | |
|---|---|---|---|
| 3,826,055 | 7/1974 | Bobzin et al. | 52/512 X |
| 3,868,803 | 3/1975 | Bice | 52/511 X |
| 3,950,908 | 7/1976 | Van Eyk | 52/506 X |
| 3,962,504 | 6/1976 | Sherwin | 52/420 X |
| 4,267,680 | 5/1981 | Delattre | 52/506 X |
| 4,433,523 | 2/1984 | Miedaner et al. | 52/592 |
| 4,468,906 | 9/1984 | Miedaner et al. | 52/279 |

*Primary Examiner*—David A. Scherbel
*Assistant Examiner*—Creighton Smith
*Attorney, Agent, or Firm*—Kinney & Lange

[57] ABSTRACT

A large-format thin-walled ceramic tile to be attached to the limits of a room with the aid of attachment elements overlapping the edge is proposed, on which reinforcement ribs made of ceramic material area attached permanently to the side of the tile facing away from the visible side in an arrangement and/or dimensioning selected according to static points of view. This provides an alternative to attachment with the aid of ceramic mounting elements attached to the side facing away from the visible side.

13 Claims, 1 Drawing Sheet

LARGE-FORMAT THIN-WALLED CERAMIC TILE

BACKGROUND OF THE INVENTION

1. Field of the Invention

The present invention relates to a large-format thin-walled ceramic tile to be attached to the limits of a room with the aid of attachment elements overlapping the edge.

2. Description of the Prior Art

It was only possible to attach ceramic tiles to the limits of a room with the aid of attachment elements overlapping the edge of the tile up to now if the format of such tiles was relatively small, e.g. in the range of 60×60 cm, since the load is only removed via the statically unfavorable attachment points at the edge. This type of attachment involves pointwise load entry, which results in high tension peaks that may damage the tile. This could be remedied by using thicker-walled tiles because they are capable of taking up a higher load. However, such a solution leads to an increase in the weight of the tile material and thus to higher costs both because of the increased material consumption and because of the increased firing expenses. Furthermore, the production of thick-walled but at the same time large-surface ceramic tiles with dimensions greater than 60×60 cm also involves considerable, as yet unsurmounted difficulties due to the uneven shrinkage over the surface and thickness of the tile that occurs during drying and firing.

In awareness of these difficulties, the applicant has already proposed attaching the relatively thin large-format ceramic tiles produced by him, which have sizes up to 125×180 cm with a thickness of only 8 mm, to the limits of a room by means of ceramic mounting elements which either (a) are attached to points of attachment determined according to static points of view on the side of the ceramic tile facing away from the visible side by means of a ceramic glaze having a melting point lower than the quartz transition point (573° C.), the fired ceramic tile provided with the corresponding fired mounting elements having been again heated to a temperature lower than the quartz transition point (of German patent application no. P 35 29 235.0), or (b) are attached to points of attachment determined according to static requirements on the side of the ceramic tile facing away from the visible side by means of a ceramic glaze whose coefficient of thermal expansion is at least approximately equal to that of the ceramic tile (of German patent application no. P 35 43 088.5), or (c) are attached to points of attachment determined according to static requirements by means of a ceramic glaze whose coefficient of thermal expansion is at least approximately equal to that of the ceramic tile, the mounting elements being fired ceramic elements serving to take up a metal attachment means (of German patent application no. P 35 44 473.8).

In all these proposals of the application, the attachment is thus effected with the aid of ceramic mounting elements attached to the side facing away from the visible side.

However, it is occasionally desirable to have an alternative allowing for attachment with the aid of attachment elements overlapping the edge.

SUMMARY OF THE INVENTION

For this purpose the invention proposes a large-format thin-walled ceramic tile to be attached to the limits of a room with the aid of attachment elements overlapping the edge, which is characterized according to the invention in that reinforcement ribs made of ceramic material are permanently attached to the side of the tile facing away from the visible side in an arrangement and/or dimensioning selected according to static points of view.

This measure not only allows for the desired attachment with the aid of attachment elements overlapping the edge of the tile but also ensures in particular that such an attachment is possible on outside facades, where relatively high wind suction forces act on the ceramic tiles.

It is particularly advantageous for the ceramic material of which the reinforcement ribs are made to have the same coefficient of thermal expansion as the material of the ceramic tile.

A preferred embodiment of an inventive tile is characterized in that already fired reinforcement ribs are permanently attached to an already fired tile by means of a ceramic glaze whose melting point is lower than the quartz transition point, the tile provided with the reinforcement ribs having been again heated to a temperature lower than the quartz transition point (573° C.).

It is advantageous in this case for the ceramic glaze serving to attach the reinforcement ribs permanently to the tile to have the same coefficient of thermal expansion as the tile and/or the reinforcement ribs.

The invention thus ensures that the reinforcement ribs to be provided on the side facing away from the visible side are disposed and/or dimensioned exclusively according to static points of view. Thus, optimal solutions can be obtained. Furthermore, a permanent bond between the tile and the reinforcement ribs in guaranteed.

The fact that the glaze establishing the bond and the tile or rib material have the same coefficient of thermal expansion prevents cracks from arising due to shearing when the temperature fluctuates. Such cracks are dangerous in particular in the case of outer facings exposed to weather, because rain that might penetrate the cracks may impair the bond and the effect of frost may even burst it.

If according to the special embodiment, the reinforcement ribs and tile are connected using a glaze whose melting point is lower than the quartz transition point (573° C.), this ensures that during the firing to connect the tile and reinforcement ribs the glaze melts in a temperature range in which no damage can be caused to the tile, the reinforcement ribs, or the glaze applied to the visible side of the ceramic tile.

The reinforcement ribs are seated in the parts on the side of the tile facing away from the visible side which offer the best static conditions. The peripheral areas serve only the purpose of mounting, without giving rise to the disadvantages connected with peripheral attachment. Thus, the invention makes it possible to transfer a type of mounting as known in the case of peripheral attachment for smaller-format tiles to large-format tiles as well.

BRIEF DESCRIPTION OF THE DRAWINGS

The drawing shows in:

FIG. 1 a bottom view of an inventive tile, and in

DETAILED DESCRIPTION OF THE PREFERRED EMBODIMENTS

Figure 1:
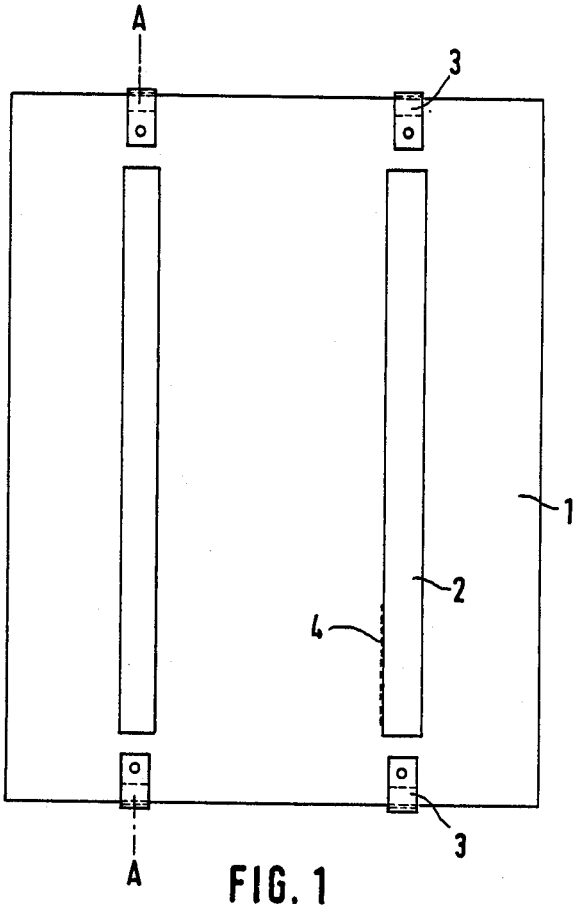
Figure 2:
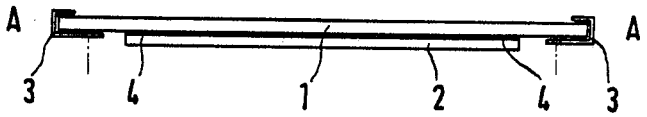
FIG. 2 a cross-section along line A—A in FIG. 1.

FIG. 1 shows a ceramic tile with reinforcement ribs 2 disposed on its side facing away from the visible side. Furthermore, attachment elements 3 attached to the walling or a substructure engage the edge of this ceramic tile. Reinforcement ribs 2 are attached to the side of tile 1 facing away from the visible side by a glaze 4, which is indicated schematically. Reinforcement ribs 2 are disposed and dimensioned according to static points of view. The arrangement as shown in the drawing is not obligatory. The same applies to the shape and dimensions of reinforcement ribs 2.

What is claimed is:

1. A large-format thin-walled ceramic tile, having a visible side, a side facing away from the visible side and a peripheral edge adapted to be attached to the limits of a room by attachment elements overlapping the peripheral edge, the tile comprising: a plurality of reinforcement ribs (2) made of ceramic material, and ceramic glaze means (4) for permanently attaching the ribs (2) to the side of the tile (1) facing away from the visible side in an arrangement and/or dimensioning selected according to static points of view.

2. A tile according to claim 1, wherein the ceramic material of which the reinforcement ribs (2) are made has the same coefficient of thermal expansion as the material of the ceramic tile (1).

3. A tile according to claim 1, wherein the tile (1) and ribs (2) are fired prior to atachment by the ceramic glaze means (4), and wherein the ceramic glaze means (4) has a melting point lower than 573° C.

4. A tile according to claim 3, wherein the ceramic glaze means (4) serving to attach the reinforcement ribs (2) permanently to the tile (1) has the same coefficient of thermal expansion as the tile (1) and the reinforcement ribs (2).

5. A reinforced large-format thin-walled ceramic tile designed to be edge-supported, the til comprising:

a flat ceramic component having a visible side and a side facing away from the visible side;

at least one ceramic reinforcement rib attached permanently to the side facing away from the visible side; and ceramic glaze means for permanently attaching each rib to the side of the tile facing away from the visible side.

6. The title of claim 5 wherein the flat ceramic component and the ceramic reinforcement rib have the same coefficient of thermal expansion.

7. The tile of claim 5 wherein the ceramic glaze means is a glaze having a

8. The tile of claim 7 wherein the flat ceramic component and the ceramic reinforcing ribs are fired prior to attachment by the ceramic glaze means between the ribs and the surface facing away from the visible side.

9. A large-format thin-walled ceramic tile designed to be edge-supported, the tile comprising:

a flat ceramic component having a visible side and a side facing away from the visible side;

a plurality of ceramic reinforcement ribs;

ceramic glaze means for bonding each of the ribs to the side facing away from the visible side of the tile and for permitting the tile to expand and contract while remaining relatively free of cracks.

10. The tile of claim 8 wherein the ribs are arranged generally parallel and dimensioned such that the tile may be supported by its peripheral edges.

11. The tile of claim 9 wherein the ceramic glaze means is a glaze bond and the visible side is coated with a glaze having a melting temperature higher than the melting temperature of the glaze bond.

12. A method of producing a reinforced large-format thin-walled tile comprising:

firing formed ceramic reinforcing ribs and a flat ceramic component having a visible side, a side facing away from the visible side and a peripheral edge;

applying a glaze between the ribs and the side facing away from the visible side, the glaze having a melting temperature less than 573° C.;

assembling the ribs and a ceramic component; and heating the ceramic component, ribs and glaze to a temperature less than 573° C. to bond the ribs to the side facing away from the visible side.

13. The product of claim 12 wherein the ribs, the thin-walled component and the glaze have identical coefficients of thermal expansion and the ribs are dimensioned and arranged such that the product is supportable by attachment elements overlapping the peripheral edle of the thin-walled element.

* * * * *

UNITED STATES PATENT AND TRADEMARK OFFICE

CERTIFICATE OF CORRECTION

PATENT NO. : 4,815,248

DATED : March 28, 1989

INVENTOR(S) : Martin Bard

It is certified that error appears in the above-identified patent and that said Letters Patent is hereby corrected as shown below:

Column 3, line 33, delete "atachment", insert "attachment"

Column 3, line 42, delete "til", insert "tile"

Column 4, line 8, following "a", insert "coefficient of thermal expansion approximately the same as the coefficient of thermal expansion of the flat ceramic component and the rib."

Column 4, line 22, delete "claim 8", insert "claim 9"

Column 4, line 25, delete "claim 9", insert "claim 10"

Column 4, line 47, delete "edle", insert "edge"

Signed and Sealed this

Twenty-sixth Day of September, 1989

*Attest:*

DONALD J. QUIGG

*Attesting Officer*

*Commissioner of Patents and Trademarks*